US006386385B1

(12) United States Patent
Amanat et al.

(10) Patent No.: US 6,386,385 B1
(45) Date of Patent: May 14, 2002

(54) METHODS AND APPARATUS FOR REMOVING TAMPER-PROOF SEALS FROM CONTAINERS

(75) Inventors: Alex H. Amanat, Wildwood; Paul H. Wunderlich, Chesterfield, both of MO (US)

(73) Assignee: Minimizim, LLC, Chesterfield, MO (US)

( * ) Notice: Subject to any disclaimer, the term of this patent is extended or adjusted under 35 U.S.C. 154(b) by 0 days.

(21) Appl. No.: 09/535,576

(22) Filed: Mar. 27, 2000

(51) Int. Cl.[7] ..... B65D 17/44; B67B 7/54

(52) U.S. Cl. ..... 220/258; 220/278; 215/228; 222/83

(58) Field of Search ..... 220/278, 277, 220/258; 215/228, 250, 295, 296, 297; 222/81, 83, 83.5

(56) References Cited

U.S. PATENT DOCUMENTS 4,185,756 A * 1/1980 Sciamonte ..... 222/83.5
4,634,013 A * 1/1987 Bar-Kokhba ..... 215/228
4,709,822 A * 12/1987 Vataru ..... 215/228
4,723,687 A * 2/1988 Kutterer ..... 222/83
5,090,582 A * 2/1992 Art et al. ..... 215/228
5,505,326 A * 4/1996 Junko ..... 223/278
5,709,311 A * 1/1998 Butler et al. ..... 220/278
5,797,506 A * 8/1998 Lehmkuhl et al. ..... 215/228
6,024,234 A * 2/2000 Rink et al. ..... 215/228
6,039,198 A * 3/2000 Wolfe et al. ..... 215/228

* cited by examiner

*Primary Examiner*—Nathan J. Newhouse
(74) *Attorney, Agent, or Firm*—Armstrong Teasdale LLP; Robert B. Reeser, III

(57) ABSTRACT

An apparatus removes a tamper-proof seal from a mouth of a container and retains the tamper-proof seal to prevent any of the seal from falling into the container. The apparatus includes a body having a top surface and a bottom surface. A sidewall circumscribes the body and extends substantially perpendicularly from the top surface of the body. A first projection extends substantially perpendicularly from the top surface and is disposed radially inward from the side wall. A plurality of second projections extend from the top surface of the body and are disposed circumferentially around body top surface.

15 Claims, 4 Drawing Sheets

METHODS AND APPARATUS FOR REMOVING TAMPER-PROOF SEALS FROM CONTAINERS

BACKGROUND OF THE INVENTION

This application relates generally to tamper-proof seals and, more particularly, to an apparatus for removing tamper-proof seals.

To assure customers that various products have not been tampered with prior to use by the consumer, the mouths of containers storing such products have been sealed. Products that include such seals include commercial products ingested by humans, pharmaceuticals, nasal sprays, motor oils, anti-freezes, insecticides, solvents, etc. The seals are known as "tamper-proof seals" and are typically fabricated from membrane or thin foil-like seals secured by an adhesive about the periphery of the container mouths.

The seals are generally removed from the containers by the consumers to provide access to the contents of the container. Typically to remove such a tamper-proof seal, the consumer punctures the seal and/or peals away most if not all of the seal. Sometimes fragments of the tamper-proof seals are left adhering to the containers and are removed piece by piece. Removing such fragments creates an annoyance for consumers. Furthermore, because of the strengths of the adhesives commonly used in applying the tamper-proof seals, such fragments are often difficult and time-consuming for consumers to remove.

BRIEF SUMMARY OF THE INVENTION

In an exemplary embodiment, an apparatus cuts and removes a tamper-proof seal from a mouth of a container and retains the tamper-proof seal to prevent the seal from falling into the container. The apparatus includes a body having a top surface and a bottom surface. A sidewall circumscribes the body and extends substantially perpendicularly from the top surface of the body. A first projection extends substantially perpendicularly from the top surface and is disposed radially inward from the side wall. A plurality of second projections extend from the top surface of the body and are disposed circumferentially around body top surface. In the exemplary embodiment, the first projection includes at least one notch and a tip.

The second projections each include a tip and are disposed radially inward from the sidewall.

During operation, the apparatus first projection pierces the tamper-proof seal. As the first projection is inserted further into the container mouth, the second projections pierce the tamper-proof seal and the tamper-proof seal is retained within the first projection notch. The apparatus is rotated to cut the tamper-proof seal in close proximity to the container mouth. As the apparatus is removed, the tamper-proof seal is retained within the apparatus and removed with the apparatus.

DETAILED DESCRIPTION OF THE INVENTION

Figure 1:
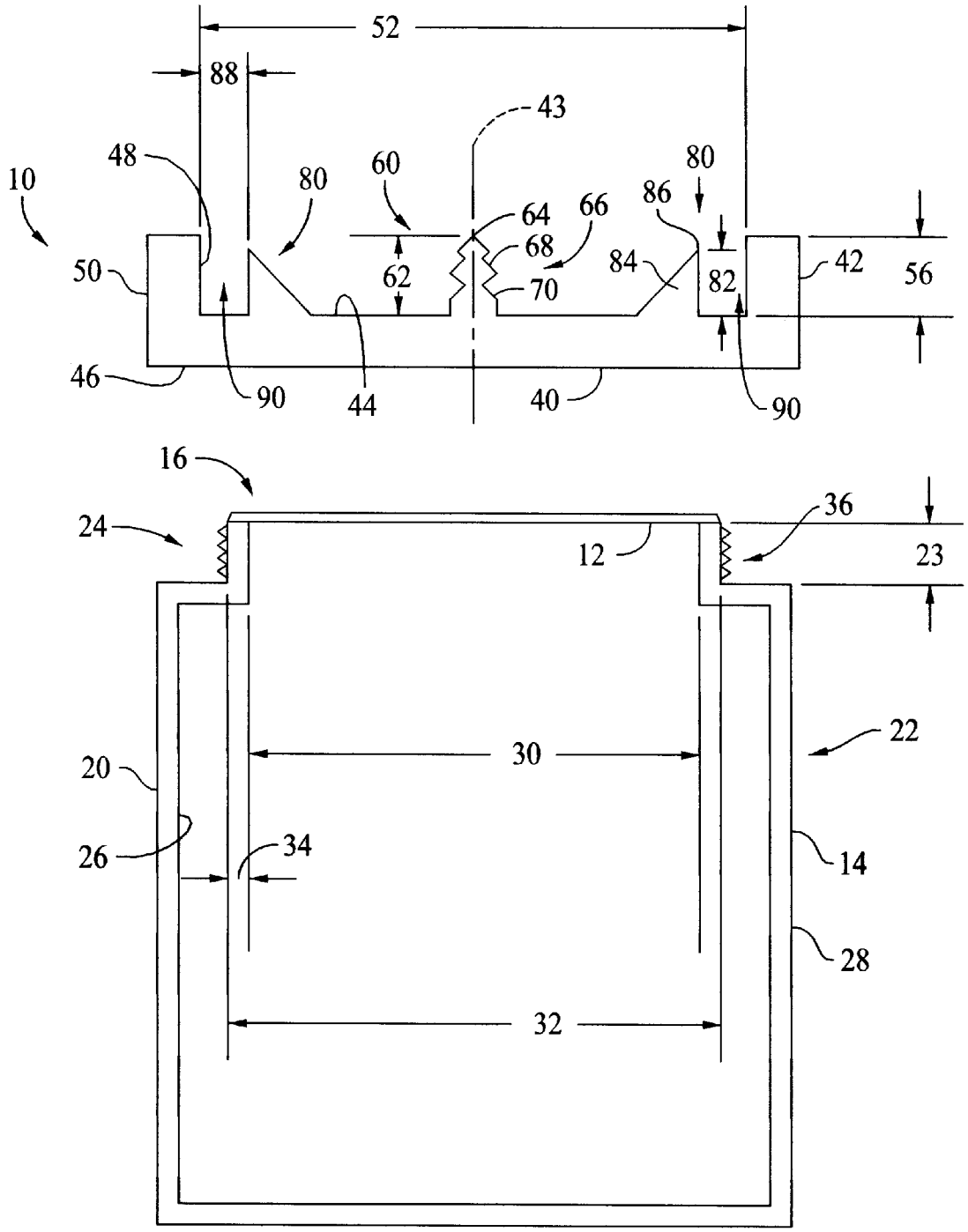
FIG. 1 is a side cross-sectional view of an apparatus and a container including a tamper-proof seal.

FIG. 1 is a side cross-sectional view of an apparatus 10 used to remove a tamper-proof seal 12 attached to a container 14. Tamper-proof seal 12 is attached to container 14 to seal an opening 16 of container 14 and provide a visual indication whether container 14 has been opened. In one embodiment, tamper-proof seal 12 is fabricated from aluminum. Alternatively, tamper-proof seal 12 may be fabricated from any other material that seals container opening 16 to prevent contaminants from entering container 14 and provides a visual indication whether container 14 has been opened, including, but not limited to foils, membranes, cellophane, plastic, or heat shrinkable plastic. In one embodiment, container 12 may hold household products including, but not limited to, products containing chemicals, paints, products, alcohol, cleaning solutions, glues, toxins, or lawn products. In another embodiment, container 12 may hold automotive products including, but not limited to, antifreeze, solvents, cleaning products, or petroleum products. In a further embodiment, container 12 may hold medical or pharmaceutical products. In yet another embodiment, container 12 may hold consumable products including bottled drinking fluids, condiments, or yogurts. In yet a further embodiment, container 12 may hold military or industrial products.

Container opening 16 includes a wall 20 extending from a body portion 22 a distance 23 and forming a neck 24. Wall 20 includes an inner surface 26 and an outer surface 28. Inner surface 26 defines an inner diameter 30 for opening 16. An outer diameter 32 for neck 24 is measured with respect to neck outer surface 30. Accordingly, wall 20 has a thickness 34 within container neck 24. Tamper-proof seal 12 extends across opening inner diameter 30 and is attached to container wall 20. Outer surface 28 includes a plurality of threads 36 sized to receive a container cap (not shown in FIG. 1). Alternatively, outer surface 28 includes a plurality of interlocking notches and slots (not shown) corresponding to a plurality of interlocking projections (not shown) extending from the container cap.

Apparatus 10 includes a body 40 and a sidewall 42 and has an axis of symmetry 43 extending through body 40. Body 40 includes a top surface 44 and a bottom surface 46. Body 40 has a substantially circular cross-sectional profile. Alternatively, body 40 may have a non-circular cross-sectional profile. Top and bottom surfaces 44 and 46, respectively, are substantially planar and are substantially parallel. Sidewall 42 circumscribes body 40 and extends substantially perpendicularly from body top surface 46.

Sidewall 42 includes an inner surface 48 and an outer surface 50. Inner surface 48 defines an inner diameter 52 larger than container neck outer diameter 32. In one embodiment, apparatus sidewall 42 is adjustably coupled to apparatus body 40 such that sidewall inner diameter 52 is variable. Sidewall 42 has a height 56 measured with respect to apparatus body top surface 46. Sidewall height 56 is less than container neck height 23.

A first projection 60 extends substantially perpendicularly from apparatus body top surface 46 a distance 62. Distance 62 is less than sidewall height 56 and is measured between body top surface 46 and a tip 64 of projection 60. Accordingly, apparatus sidewall 42 extends outward from apparatus body 40 farther than first projection 60. First projection 60 is disposed radially inward from apparatus sidewall 42. In one embodiment, sidewall 42 is positioned coincident with apparatus axis of symmetry 43.

Projection 60 includes a body 66 extending between tip 64 and apparatus body top surface 46. Body 66 includes a first notch 68 and a second notch 70. First notch 68 circumscribes first projection 60 and is disposed between tip 64 and second notch 70. Second notch 70 circumscribes first projection 60 and is disposed between tip first notch 68 and apparatus body top surface 46. In one embodiment, first projection 60 includes more than two notches.

A plurality of second projections 80 extend from apparatus body top surface 46 a distance 82. Distance 82 is less than sidewall height 56 and less than first projection height 62. Accordingly, apparatus sidewall 42 extends outward from apparatus body 40 farther than second projections 80. Each of second projections 80 includes a body 84 and a tip 86. Each body 84 extends between apparatus body top surface 46 and tip 86. Distance 82 is measured between apparatus body top surface 46 and tip 86. In one embodiment, second projections 80 are saw-tooth projections.

Second projections 80 are disposed circumferentially around apparatus 10 and surround first projection 60. Second projections 80 are disposed a distance 88 radially inward from apparatus sidewall 42. Distance 88 is slightly larger than container wall thickness 34. A gap 90 is defined between second projections 80 and apparatus sidewall 42. In one embodiment, second projections 80 are adjustably coupled to apparatus body 40 such that distance 88 is adjustable.

During operation, apparatus 10 is positioned above container opening 16 such that apparatus first projection 60 is in close proximity to tamper-proof seal 12 covering container opening 16 and is approximately centered above tamper-proof seal 12. When apparatus first projection 60 is approximately centered above tamper-proof seal 12, apparatus sidewall 42 is positioned circumferentially radially outward from container neck wall outer surface 28 and apparatus second projections 80 are positioned radially inward in close proximity to neck wall inner surface 26.

After being positioned above container opening 16, apparatus 10 is brought into contact with container 14 such that container wall 20 is circumferentially inserted into apparatus gap 90 defined between second projections 80 and apparatus sidewall 42. Simultaneously, apparatus first projection 60 pierces tamper-proof seal 12 and as apparatus 10 is forced downward around container opening 16, tamper-proof seal 12 is retained in apparatus first projection first notch 68.

Additional pressure is applied to apparatus 10 to force container wall 20 to contact apparatus body top surface 46. Simultaneously, apparatus second projections 80 puncture tamper-proof seal 12 and depending on a tautness of tamper-proof seal 12, tamper-proof seal 12 is retained in either apparatus first projection first notch 68 or apparatus first projection second notch 70.

After apparatus second projections 80 puncture tamper-proof seal 12, apparatus 10 is rotated and second projections 80 cut tamper-proof seal 12 away from container 14 in close proximity to container wall 20. When apparatus 10 is removed from container 16, tamper-proof seal 12 is retained by apparatus first projection 60 and is removed from container opening 16 without the risk of any of tamper-proof seal 12 falling into container 16.

Figure 2:
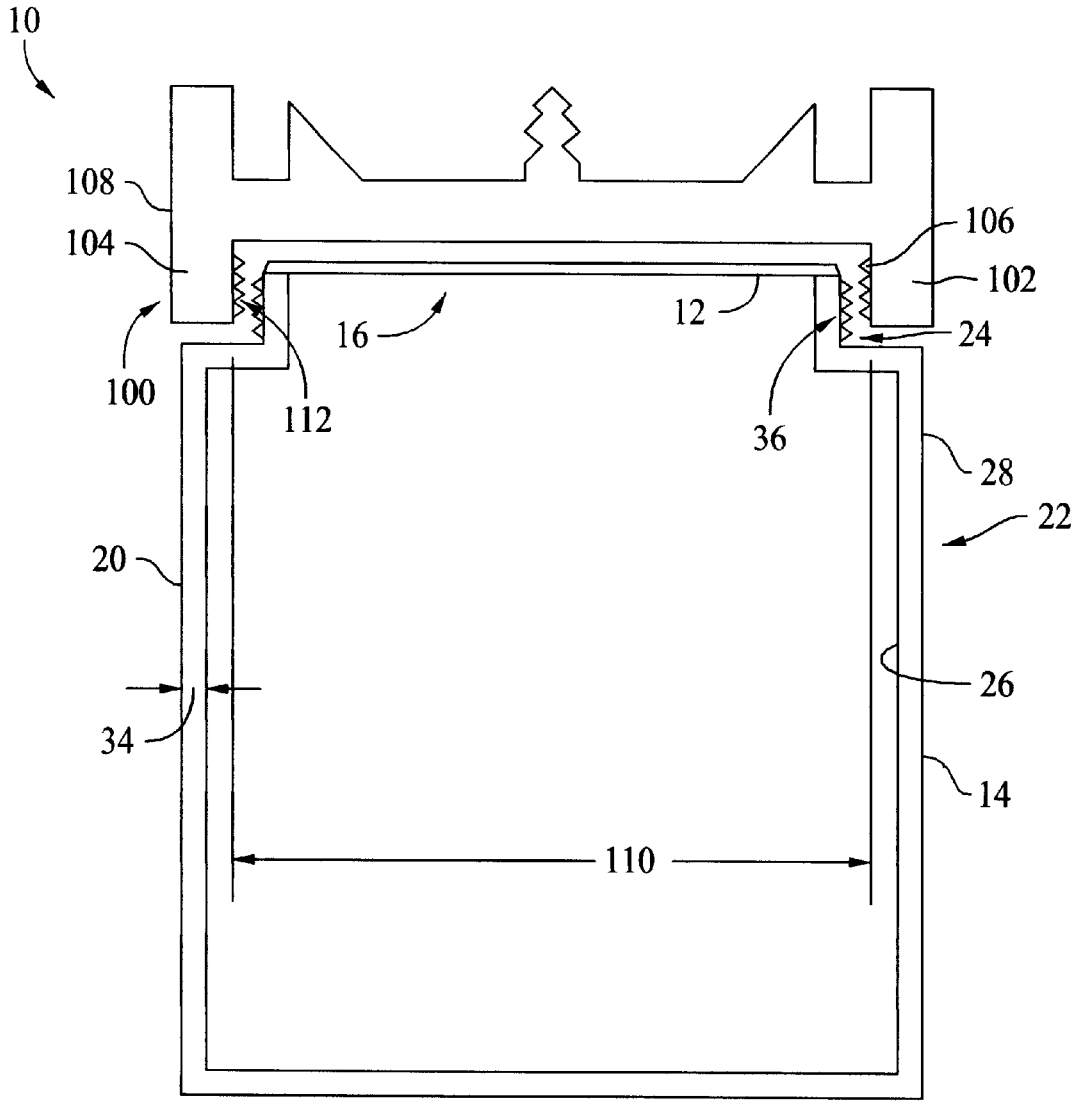
FIG. 2 is a container cap assembly including the apparatus shown in FIG. 1.

FIG. 2 is a side cross-sectional view of a container cap assembly 100. Container cap assembly 100 includes apparatus 10 and a container cap 102. Container cap 102 is disposed adjacent apparatus body bottom surface 44. In one embodiment, apparatus 10 is attached to container cap 102. Alternatively, as shown in FIG. 2, apparatus 10 is formed integrally with container cap 102.

Container cap 102 includes a second sidewall 104 extending from apparatus body bottom surface 44 and circumscribing apparatus body 40. Second sidewall 104 extends substantially perpendicularly from apparatus body bottom surface 44 and includes an inner surface 106 and an outer surface 108. Inner surface 106 defines an inner diameter 110 slightly larger than container neck outer diameter 32. Accordingly, container cap 102 is sized to rotatably attach to container 16 to close container cap opening 16. In one embodiment, second sidewall 104 includes a plurality of threads 112 sized to receive plurality of threads 36 disposed on container outer surface 28. Alternatively, cap 102 is a child-resistant type of cap and second sidewall 104 includes a plurality of interlocking projections (not shown) corresponding to a plurality of interlocking notches and slots.

During operation, cap assembly 100 is attached to container 14 such that container cap 102 is rotatably coupled to container neck 24 and tamper-proof seal 12 covers container opening 16. To remove tamper-proof seal 12 with cap assembly 100, container cap 102 is uncoupled and removed from container 14 exposing tamper-proof seal 12. Cap assembly 100 is inverted such that apparatus 10 is positioned above container opening 16 in close proximity to tamper-proof seal 12. Apparatus 10 is used to remove tamper-proof seal 12 (as described in FIG. 1) and cap assembly 100 is inverted such that container cap 102 may be rotatably coupled to container 14 to cover container opening 16.

Figure 3:
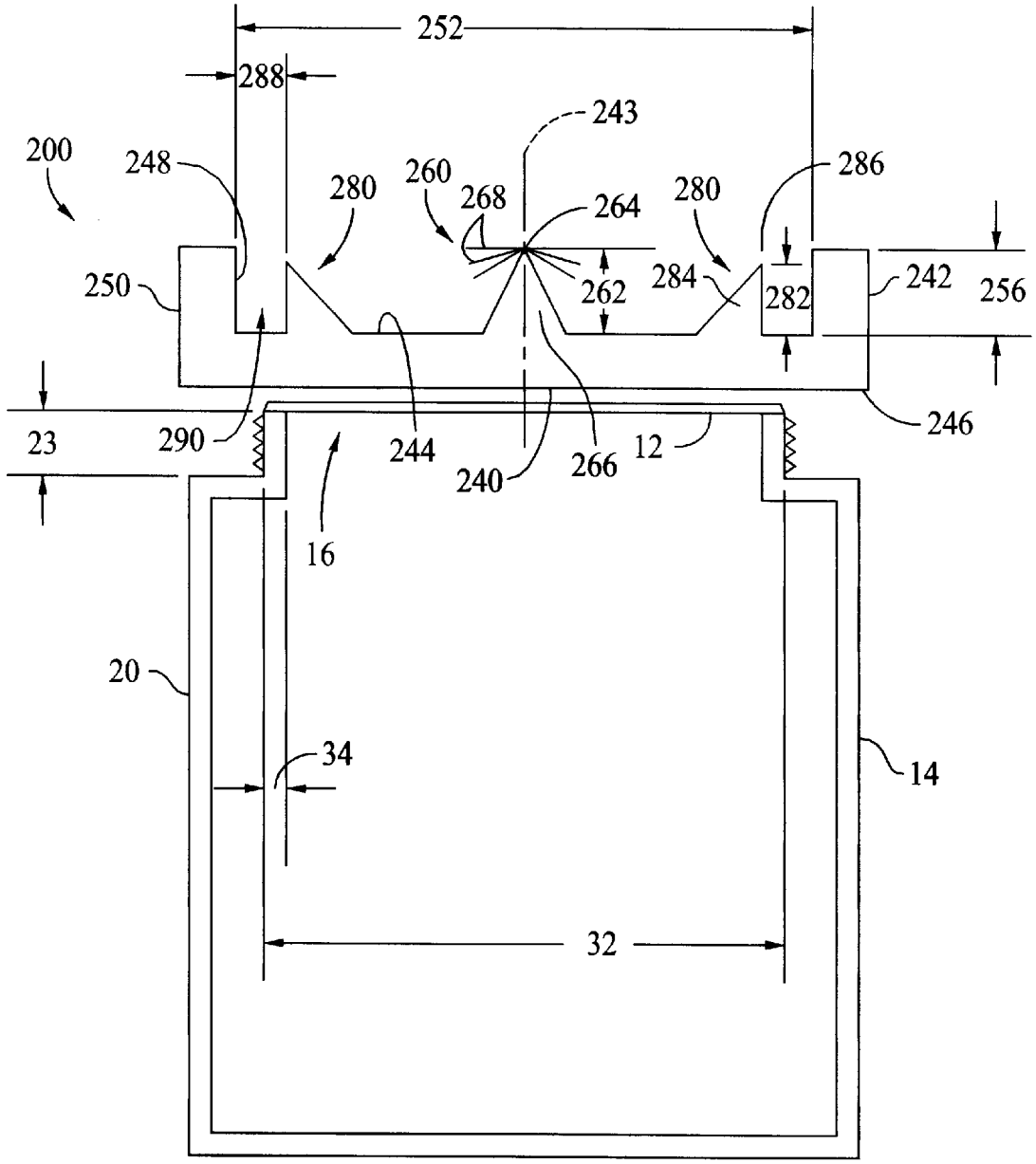
FIG. 3 is a side cross-sectional view of an alternative embodiment of the apparatus shown in FIG. 1.

FIG. 3 is a side cross-sectional view of an alternative embodiment of an apparatus 200 used to remove tamper-proof seal 12 from container 14. In one embodiment, apparatus 200 is attached to container cap assembly 100 (shown in FIG. 2). In an alternative embodiment, apparatus 200 is formed integrally with container cap assembly 100. Apparatus 200 includes a body 240 and a sidewall 242 and has an axis of symmetry 243 extending through body 240. Body 240 includes a top surface 244 and a bottom surface 246. Body 240 has a substantially circular cross-sectional profile. Alternatively, body 240 may have a non-circular cross-sectional profile. Top and bottom surfaces 244 and 246, respectively, are substantially planar and are substantially parallel. Sidewall 242 circumscribes body 240 and extends substantially perpendicularly from body top surface 246.

Sidewall 242 includes an inner surface 248 and an outer surface 250. Inner surface 248 defines an inner diameter 252 larger than container neck outer diameter 32. In one embodiment, apparatus sidewall 242 is adjustably coupled to apparatus body 240 such that sidewall inner diameter 252 is variable. Sidewall 242 has a height 256 measured with respect to apparatus body top surface 246. Sidewall height 256 is less than container neck height 23.

A first projection 260 extends substantially perpendicularly from apparatus body top surface 246 a distance 262. Distance 262 is less than sidewall height 256 and is measured between body top surface 246 and a tip 264 of projection 260. Accordingly, apparatus sidewall 242 extends outward from apparatus body 240 farther than first projection 260. First projection 260 is disposed radially inward from apparatus sidewall 242. In one embodiment, sidewall 242 is positioned coincident with apparatus axis of symmetry 243.

Projection 260 includes a body 266 extending between tip 264 and apparatus body top surface 246. Body 266 includes a plurality of filaments 268 extending radially outward from body 266 and disposed adjacent projection tip 264. Filaments 268 are disposed circumferentially around projection body 266.

A plurality of second projections 280 extend from apparatus body top surface 246 a distance 282. Distance 282 is less than sidewall height 256 and less than first projection height 262. Accordingly, apparatus sidewall 242 extends outward from apparatus body 240 farther than second projections 280. Each of second projections 280 includes a body 284 and a tip 286. Each body 284 extends between apparatus body top surface 246 and tip 286. Distance 282 is measured between apparatus body top surface 246 and tip 286. In one embodiment, second projections 280 are saw-tooth projections.

Second projections 280 are disposed circumferentially around apparatus 200 and surround first projection 260. Second projections 280 are disposed a distance 288 radially inward from apparatus sidewall 242. Distance 288 is slightly larger than container wall thickness 34. A gap 290 is defined between second projections 280 and apparatus sidewall 242. In one embodiment, second projections 280 are adjustably coupled to apparatus body 240 such that distance 288 is adjustable.

During operation, apparatus 200 is positioned above container opening 16 such that apparatus first projection 260 is in close proximity to tamper-proof seal 12 covering container opening 16 and is approximately centered above tamper-proof seal 12. When apparatus first projection 260 is approximately centered above tamper-proof seal 12, apparatus sidewall 242 is positioned circumferentially radially outward from container neck wall outer surface 28 and apparatus second projections 280 are positioned radially inward in close proximity to neck wall inner surface 26.

After being positioned above container opening 16, apparatus 200 is brought into contact with container 14 such that container wall 20 is circumferentially inserted into apparatus gap 290 defined between second projections 280 and apparatus sidewall 242. Simultaneously, apparatus first projection 260 pierces tamper-proof seal 12 and first projection filaments 268 flex and are forced through tamper-proof seal 12.

Additional pressure is applied to apparatus 200 to force container wall 20 to contact apparatus body top surface 246. Simultaneously, apparatus second projections 280 puncture tamper-proof seal 12 and first projection filaments 268 spring radially outward from first projection 260 once through an opening (not shown) created in tamper-proof seal 12 by first projection tip 264. Because filaments 268 extend radially outward from first projection 260, tamper-proof seal 12 is retained in apparatus 200 with filaments 268.

After apparatus second projections 280 puncture tamper-proof seal 12, apparatus 200 is rotated and second projections 280 cut tamper-proof seal 12 away from container 14 in close proximity to container wall 20. When apparatus 200 is removed from container 16, tamper-proof seal 12 is retained by apparatus first projection filaments 268 and is removed from container opening 16 without the risk of any of tamper-proof seal 12 falling into container 16.

Figure 4:
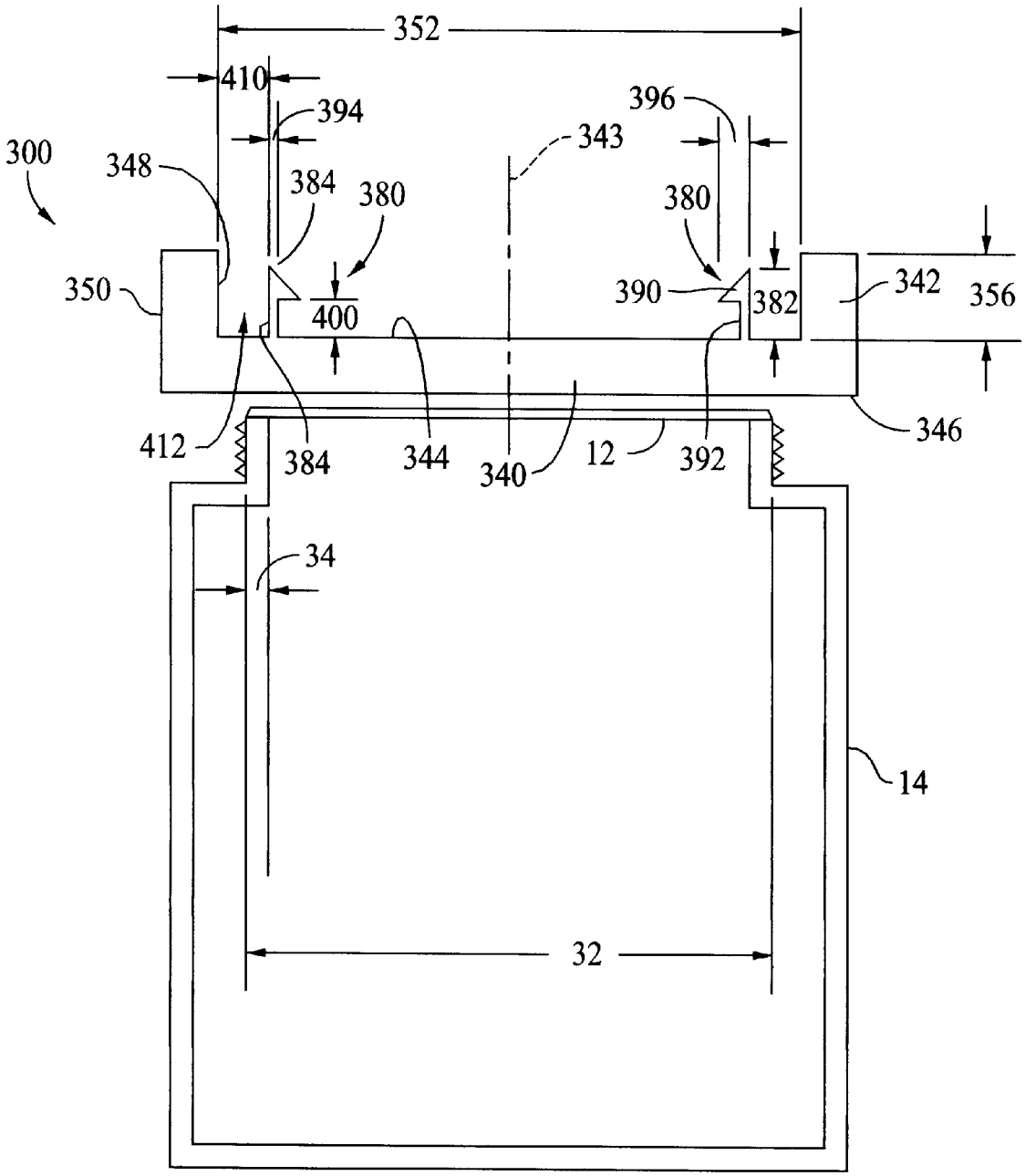
FIG. 4 is a side cross-sectional view of another embodiment of the apparatus shown in FIG. 1.

FIG. 4 is a side cross-sectional view of another embodiment of an apparatus 300 used to remove tamper-proof seal 12 from container 14. In one embodiment, apparatus 300 is attached to container cap assembly 100 (shown in FIG. 2). In an alternative embodiment, apparatus 300 is formed integrally with container cap assembly 100. Apparatus 300 includes a body 340 and a sidewall 342 and has an axis of symmetry 343 extending through body 340. Body 340 includes a top surface 344 and a bottom surface 346. Body 340 has a substantially circular cross-sectional profile. Alternatively, body 340 may have a non-circular cross-sectional profile. Top and bottom surfaces 344 and 346, respectively, are substantially planar and are substantially parallel. Sidewall 342 circumscribes body 340 and extends substantially perpendicularly from body top surface 346.

Sidewall 342 includes an inner surface 348 and an outer surface 350. Inner surface 348 defines an inner diameter 352 larger than container neck outer diameter 32. In one embodiment, apparatus sidewall 342 is adjustably coupled to apparatus body 340 such that sidewall inner diameter 352 is variable. Sidewall 342 has a height 356 measured with respect to apparatus body top surface 346. Sidewall height 356 is less than container neck height 23.

A plurality of projections 380 extend from apparatus body top surface 346 a distance 382. Distance 382 is less than sidewall height 356 and accordingly, apparatus sidewall 342 extends outward from apparatus body 340 farther than projections 380. Each projection 380 includes a body 384, and a tip 386. Each body 384 extends between apparatus body top surface 346 and tip 386. Distance 382 is measured between apparatus body top surface 346 and tip 386.

Each body 384 includes a first portion 390 and a second portion 392. Each first portion 390 extends between apparatus body top surface 346 and body second portion 392. Each second portion 392 extends between body first portion 390 and projection tip 386. Body first portion has a thickness 394 that is substantially uniform between apparatus body top surface 346 and body second portion 392. Body second portion is substantially conical and tapers outward from tip 386 to a thickness 396. Thickness 396 is greater than body first portion thickness 394 and accordingly a shoulder 398 is created between body first portion 390 and body second portion 392. Each projection shoulders 394 is located a distance 400 from apparatus body top surface 346.

Projections 380 are disposed circumferentially around apparatus 300 a distance 410 radially inward from apparatus sidewall 342. Distance 410 is slightly larger than container wall thickness 34. A gap 412 is defined between projections 380 and apparatus sidewall 342. In one embodiment, projections 380 are adjustably coupled to apparatus body 340 such that distance 410 is adjustable.

During operation, apparatus 300 is positioned above container opening 16 such that apparatus projections 380 are in close proximity to tamper-proof seal 12 covering container opening 16 while apparatus sidewall 342 is positioned circumferentially radially outward from container neck wall outer surface 28. As apparatus 300 is brought into contact with container 14, container wall 20 is circumferentially inserted into apparatus gap 412 defined between projections 380 and apparatus sidewall 342. Simultaneously, apparatus projections 380 pierce tamper-proof seal 12. Tamper-proof seal 12 contracts as tapered projection body second portions 392 pierce tamper-proof seal 12.

As additional pressure is applied to apparatus 300 to force container wall 20 to contact apparatus body top surface 346, tamper-proof seal 12 expands slightly and is retained by projection shoulders 394. Apparatus 200 is then rotated and projections 380 cut tamper-proof seal 12 away from container 14 in close proximity to container wall 20. When apparatus 300 is removed from container 16, tamper-proof seal 12 is retained by apparatus projection shoulders 394 and is removed from container opening 16 without the risk of any of tamper-proof seal 12 falling into container 16.

The above described apparatus is cost-effective and reliable. The apparatus includes a first projection and a plurality of second projections which pierce the tamper-proof seal and circumferentially cut the seal from the container. When the apparatus is removed from the container, the tamper-proof seal is retained in the apparatus without any of the tamper-proof seal falling into the container. As a result, a cost-effective and reliable apparatus is provided.

While the invention has been described in terms of various specific embodiments, those skilled in the art will recognize that the invention can be practiced with modification within the spirit and scope of the claims.

What is claimed is:

1. An apparatus for removing a tamper-proof seal from an opening of a container, said apparatus comprising:

a body comprising a top surface and a bottom surface;

a sidewall circumscribing said body and extending substantially perpendicularly from said body top surface;

a first projection extending substantially perpendicularly from said body top surface, said first projection disposed radially inward from said sidewall and comprising at least one notch and a first tip, said notch configured to retain the tamper-proof seal, said tip configured to pierce the tamper-proof seal; and a plurality of second projections extending from said body top surface and disposed radially inward from said sidewall, said first projection further comprising a plurality of filaments extending radially outward from said first projection tip.

2. An apparatus in accordance with claim 1 wherein said filaments configured to retain the tamper-proof seal.

3. An apparatus in accordance with claim 1 wherein each of said plurality of second projections comprises a second tip.

4. An apparatus in accordance with claim 1 wherein said first projection is disposed radially inward from said plurality of second projections.

5. An apparatus in accordance with claim 1 wherein said plurality of second projections circumferentially surround said first projection.

6. An apparatus in accordance with claim 1 wherein said first projection extends from said body top surface a first distance, said plurality of second projections extend from said body top surface a second distance, said sidewall extends from said body top surface a third distance, said third distance greater than said first distance and said second distance.

7. An apparatus in accordance with claim 6 wherein said first distance greater than said second distance.

8. An apparatus in accordance with claim 1 further comprising a container cap extending from said apparatus body bottom surface, said container cap configured to attach to the container.

9. An apparatus in accordance with claim 8 wherein said container cap comprises a plurality of threads.

10. A cap for a container including an opening, the opening defined by a lip and covered with a tamper-proof seal, said cap comprising:

a body comprising a top surface and a bottom surface;

a first sidewall circumscribing said body and extending substantially perpendicularly from said body top surface;

a second sidewall circumscribing said body and extending from said body bottom surface; and a first projection extending substantially perpendicularly from said body bottom surface, said first projection disposed radially inward from said second sidewall, said first projection further comprises a plurality of filaments extending radially outward from said first projection tip, said filaments configured to retain the tamper-proof seal.

11. A cap in accordance with claim 10 further comprising a plurality of second projections extending from said body bottom surface, said plurality of second projections disposed radially inward a first distance from said second sidewall.

12. A method for removing a tamper-proof seal from an opening of a container using an apparatus, the apparatus including a body, a sidewall, and a first projection, the body having a top surface and a bottom surface, the sidewall circumscribing the body and extending from the body top surface, the first projection extending substantially perpendicularly from the body top surface and disposed radially inward from the sidewall, the first projection further includes a plurality of filaments extending radially outward from the first projection tip, said method comprising the steps of:

positioning the apparatus in close proximity to the container opening;

piercing the tamper-proof seal with the first projection;

rotating the apparatus; and removing the apparatus with the tamper-proof seal retained therein by the filaments after the first projection has pierced the tamper-proof seal.

13. A method in accordance with claim 12 wherein the apparatus further includes a cap extending from the apparatus body bottom surface, the cap configured to attach to the container, said step of positioning the apparatus further comprising:

removing the cap from the container opening; and inverting the cap above the container opening.

14. A method in accordance with claim 12 wherein the container opening is defined by a lip having a thickness, the apparatus further including a plurality of second projections disposed radially inward from the sidewall, each of the plurality of second projections includes a tip, the plurality of second projections disposed radially inward from the sidewall a first distance, the first distance greater than the container lip thickness, said step of positioning the apparatus further comprising positioning the apparatus such that the sidewall contacts the body top surface between the sidewall and the plurality of second projections.

15. A method in accordance with claim 14 wherein the first projection is disposed radially inward from the plurality of second projections, the plurality of second projections circumferentially surround the first projection, said method further comprising piercing the tamper-proof seal with the plurality of second projections.

* * * * *